US005576582A

United States Patent [19]

White

[11] Patent Number: 5,576,582

[45] Date of Patent: Nov. 19, 1996

[54] AUTOMATIC PUMP CONTROL

[76] Inventor: Paul S. White, 3402 Hwy. 58, Swansboro, N.C. 28584

[21] Appl. No.: 306,378

[22] Filed: Sep. 15, 1994

[51] Int. Cl.[6] ..... F04B 49/06; B63B 13/00

[52] U.S. Cl. ..... 307/118; 73/304 R; 307/9.1; 417/36

[58] Field of Search ..... 307/9, 1, 118; 361/178; 417/36; 73/304 R, 290 R; 116/109; 340/618, 450; 318/482, 642, 293; 114/183 R

[56] References Cited

U.S. PATENT DOCUMENTS

| | | | |
|---|---|---|---|
| 4,454,454 | 6/1984 | Valentine | 318/293 |
| 4,612,949 | 9/1986 | Henson | 73/304 R |
| 4,728,005 | 3/1988 | Jacobs et al. | 73/304 R |
| 4,766,329 | 8/1988 | Santiago | 307/118 |
| 5,322,119 | 6/1994 | Kadwell et al. | 417/36 |

*Primary Examiner*—William M. Shoop, Jr.
*Assistant Examiner*—Richard T. Elms
*Attorney, Agent, or Firm*—Olive & Olive, P.A.

[57] ABSTRACT

An automatic pump control for a pump such as a marine vessel bilge pump uses solid state components and has no moving parts. A first integrated logic device activates an FET transistor and completes a circuit which turns the pump on when the water reaches a predetermined high level and in association with an interconnected second integrated logic device keeps the pump on until the water subsequently reaches a predetermined low level. The control can be manually operated and includes circuitry to activate a high water alarm. The switch housing is molded in a manner which permits mounting directly to the pump.

11 Claims, 2 Drawing Sheets

AUTOMATIC PUMP CONTROL

BACKGROUND OF THE INVENTION

1. Field of the Invention

This invention relates in general to automatic pump controls and particularly to an automatic control for a bilge pump such as used on a marine vessel. More specifically, the invention is directed to an improved solid state type pump control capable of automatically operating a pump submerged in a liquid so as to maintain its level within a predetermined range.

2. Description of the Related Art

It is known to provide an automatic pump control for controlling a water level such as in the bilge of a marine vessel. The most common such bilge pump control, uses a float switch to detect the water level. A float switch however is prone to stick or jam in the on position which can cause the pump to burn out or the battery used to power the pump to run down leaving the vessel at the mercy of a rising water level. Furthermore, a float switch is bulky and hard to mount in the tight space of a boat bilge. Another disadvantage of a float switch is the need to drill holes in the hull to screw the float switch down. Also, the mounting position of the float switch is critical to its proper operation.

SUMMARY OF THE INVENTION

The present invention is directed to an improved automatic solid state type pump control and is described by way of example, as an automatic pump control that can be mounted directly to a bilge pump on a marine vessel to sense and control a rising water level. If the water level is indeed too high, the pump control will automatically activate the pump to remove the water and will turn off the pump when the water level is pumped to an acceptable level. A means to manually control the pump is also provided as well as an alarm circuit to warn of a high water level.

The bilge pump control of the invention comprises a low water level detector, a high water level detector and an interconnected logic circuit which in response to signals from the level detectors controls the pump. The logic circuit uses CMOS technology and an associated pump control circuit uses TMOS technology to allow operation on only micro-amps of current.

It is thus an object of the invention to provide a bilge pumping system with automatic activation means.

It is a further object of the invention to provide an improved solid state type automatic bilge pump control that is easy to mount directly to a pump.

A further object of the invention is to provide an improved solid state automatic bilge pump control that can be both automatically and manually activated.

It is a further object of the invention to provide an improved solid state type automatic bilge pump control having an alarm which in the presence of a high water level is activated to warn of such level.

It is a further object of the invention to provide an improved solid state type automatic bilge pump control that can be manufactured at a cost competitive with that of a high quality automatic bilge pump control using a float switch without the problems associated with a float switch.

Other objects and advantages of the invention will become apparent as the description proceeds.

DETAILED DESCRIPTION OF THE INVENTION

Figure 1:
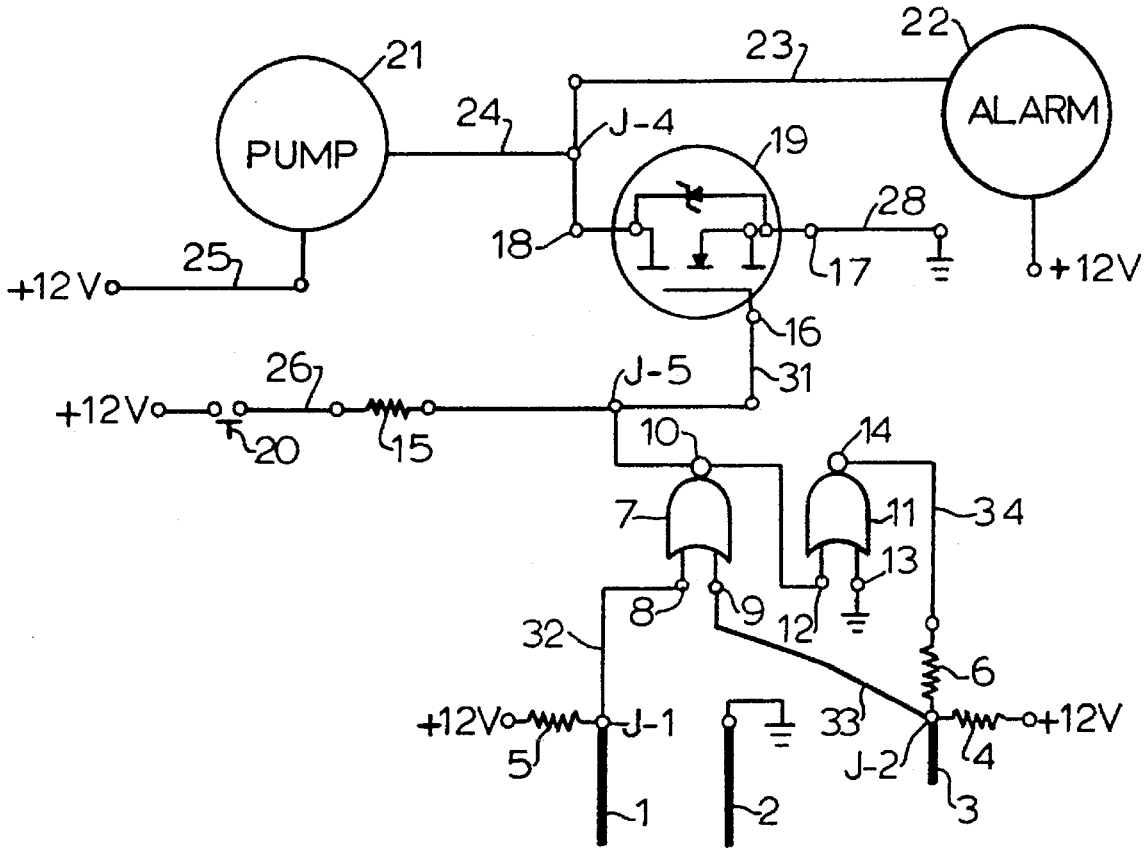
FIG. 1 is a schematic diagram of the circuitry involved in the improved pump switch control of the invention.
Figure 2:
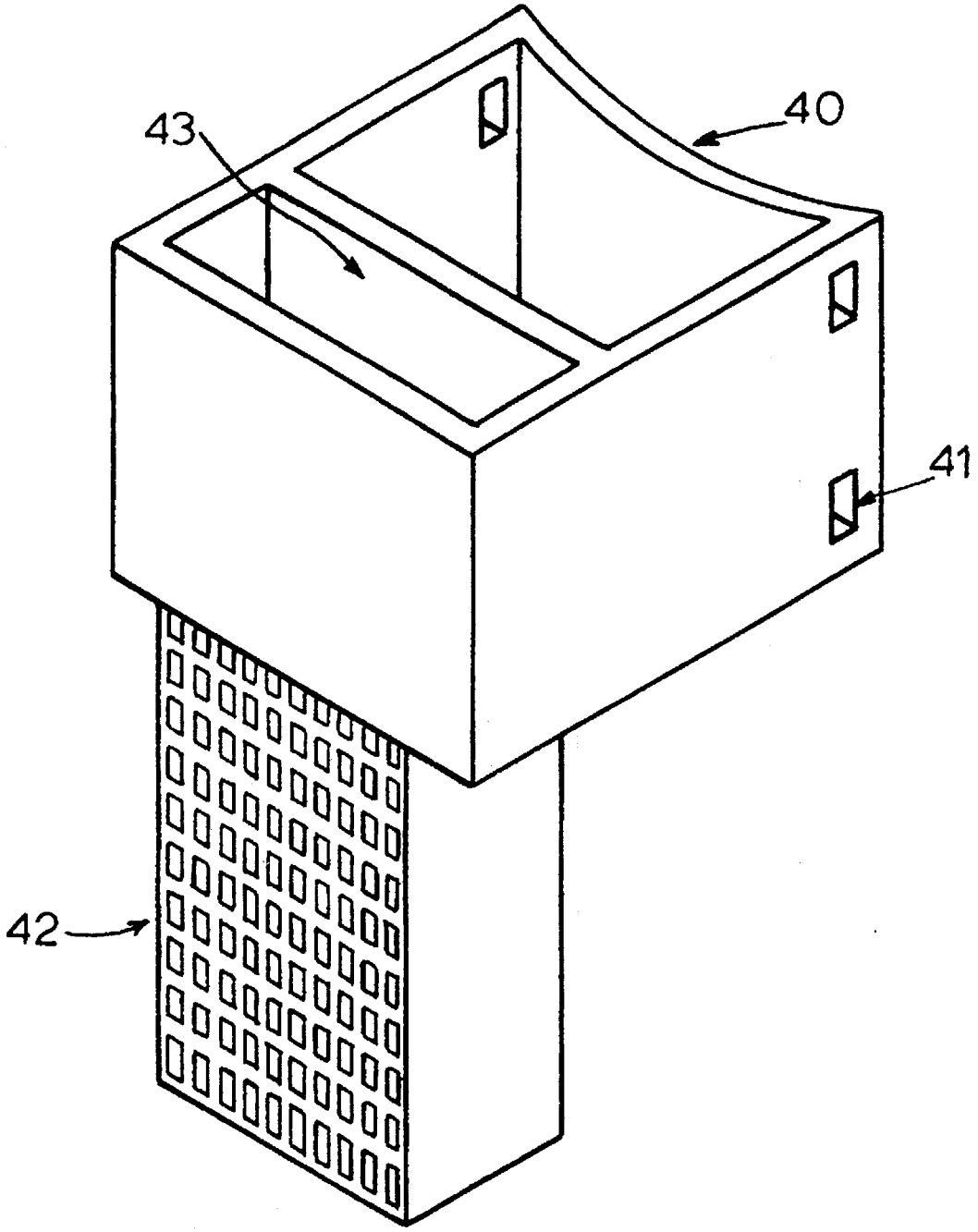
FIG. 2 is a perspective view of a preferred form of housing for housing the pump control circuitry of the invention.

As depicted in FIG. 1, the automatic pump control of the invention controls a pump 21 which by way of example can be any of the 12 volt DC models in common use for pumping the bilge of a marine vessel. The pump 21 is mounted in the lowest point in the area of the marine vessel to be protected. The housing 40 (FIG. 2) is attached to pump 21 using nylon tie straps, not shown, inserted through slots 41. Probe cover 42 which covers the later described probes is intended to rest on the bilge floor. The pump control of the invention as illustrated in FIG. 1 is adapted for both automatic and manual operation as later explained.

Pump 21 is illustrated as being connected on one side through line 25 to the positive side of a 12 volt source provided by a battery, not shown. The opposite side of pump 21 is shown connected through a line 24 to the drain terminal 18 of a TMOS FET Power Field Effect Transistor 19 whose source terminal 17 is connected to ground and the negative side of the battery through lead 28. Transistor 19 referred to in trade terminology as a TMOS FET type transistor is exemplified by Motorola number MTP5ONO5E. The gate terminal 16 of FET transistor 19 is connected through lead 31 to the output terminal 10 of a CMOS NOR GATE 7 and to the probe control circuitry next described.

The automatic pump control includes a low level probe 1 which at junction J-1 is connected both to the 12 volt positive source through a current limiting resistor 5 and through lead 32 to the input terminal 8 of a CMOS NOR GATE 7 also referred to in the trade as an integrated logic chip. An additional low level probe 2 is connected to ground as illustrated and a high level probe 3 is connected through junction J-2 to a 12 volt positive source in series with resistor 4 and is further connected through junction J-2 and lead 33 to the input terminal 9 of NOR GATE 7. Probe 3 is also connected through junction J-2 to resistor 6 and through lead 34 to the output terminal 14 of the CMOS NOR GATE 11. To complete the description of the circuitry of FIG. 1 prior to describing its operation it should be noted that the output terminal 10 of NOR GATE 7 is connected both to the input 12 of NOR GATE 11 and through lead 31 to the gate terminal 16 of the FET transistor 19. Note also that the input 13 of NOR GATE 11 is shown connected to ground. A high water level alarm system which is later described in reference to FIG. 1 is illustrated as a buzzer 22 connected on one side through lead 23 and junction J-4 to the drain terminal 18 of FET transistor 19 and on the opposite side to the 12 volt positive source. Manual operation of pump 21 as later explained is facilitated by means of a manual switch 20 connected on one side to the 12 volt positive source and on an opposite side through lead 26 to a resistor 15 which in turn is connected through junction J-5 and lead 31 to the gate terminal 16 of FET transistor 19.

In operation, conductive probes 1, 2 and 3 enclosed by probe cover 42 (FIG. 2) extend in an area to be protected from rising water. Probe cover 42 (FIG. 2) is used to filter the water in contact with probes 1, 2 and 3, thus stopping false triggering by trash or debris floating in the bilge area.

As the water level rises to touch probe 1 and probe 2, the small current limited by resistor 5 passes through probe 1 to probe 2, probe 2 being grounded. This allows the signal at input 8 of the NOR GATE 7 to drop to a low state. Probe 3 being shorter than probes 1 and 2 senses the high water level. When the water level rises high enough to touch probe 3 current passes through the water from probe 3 to probe 2. Since probe 3 is connected to input 9 of NOR GATE 7, this causes input 9 to go low. With both inputs 8 and 9 low the output 10 of NOR GATE 7 goes high supplying 12 volts to the gate terminal 16 of the FET transistor 19. The use of the described type of FET transistor 19 allows control of loads up to 50 amperes with an RDS(on) resistance between drain and source of only 0.028 ohm. The low resistance between the drain 18 and source 17 greatly reduces the heat normally generated when using transistors to control high amperage loads. Also, the gate 16 is not current dependant allowing the entire control circuit to draw only micro-amps of current. With 12 volts applied to the gate 16 of the FET transistor 19 current flows between source 17 and drain 18 completing the circuit for pump 21, turning it on. Lead 23 now completes the alarm circuit to warn of high water levels.

With the pump 21 on, the water level will begin to recede. As the water level drops below probe 3, the output 10 of NOR GATE 7 stays high due to input 9 of NOR GATE 7 being held low by the output 14 of NOR GATE 11 through resistor 6. NOR GATE 11 has its input 13 connected to ground and its input 12 connected to output 10 of NOR GATE 7, thus, when output 10 on NOR GATE 7 goes high, output 14 on NOR GATE 11 goes low, allowing output 10 on NOR GATE 7 to stay high till the water drops below probe 1 and probe 2.

When the water level drops below probe 1 and probe 2, input 8 of NOR GATE 7 goes high due to the 12 volts applied through resistor 5, with a high signal on input 8, output 10 of NOR GATE 7 goes low. With NOR GATE 11, input 12 and input 13 low, output 14 of NOR GATE 11 goes high. With output 10 of NOR GATE 7 low, the gate terminal 16 of FET transistor 19 will be at 0 volts. This turns off FET transistor 19 breaking the circuit to pump 21 and alarm lead 23 to turn off both the pump and the alarm.

As a safety feature, pump 21 can be activated by pressing switch 20 to apply 12 volts through lead 26 and current limiting resistor 15 to gate 16 of transistor 19, thus allowing manual operation of pump 21. Switch 20 may be of the normally open push or toggle type.

The circuit components shown in FIG. 1 are encapsulated in case 40 by inserting a circuit board on which the components are mounted in opening 43 (FIG. 2) then filling the opening using an epoxy potting compound to seal the circuit components from the water, oil, etc. found in the bilge of a water vessel. Furthermore, using a miniature circuit as provided by the invention will allow the pump control of the invention to be molded directly into any DC bilge pump at the time of manufacture or added to an existing DC bilge pump using case 40.

For use with existing pumps in common use a case similar to but not limited to case 40 (FIG. 2) could be manufactured by injection molding from a UL approved oil resistant plastic. Probe cover 42 could also be injection molded from the same material as case 40.

The values of the circuit elements as shown in FIG. 1 are given below in Table 1:

TABLE 1

| Element | Value |
|---|---|
| 4 | 1 meg |
| 5 | 1 meg |
| 6 | 120K |
| 15 | 1 meg |
| 7 and 11 | ¼ 4001UBE NOR GATE |
| 28 | TMOS E-FET (enhancement type) |

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. An automatic control system for controlling the level of water at a location at which the conditions permit such level to be controlled by pumping comprising:

(a) means providing a positive voltage source and a ground potential;

(b) an electrically operated pump having one side connected to said positive voltage source and an opposite side connectable to said ground potential;

(c) a transistor device having a drain terminal connected to said opposite side of said pump, a source terminal connected to said ground potential and a gate terminal operable when connected to said positive voltage source to cause an electrical path to be established between said drain and source terminals thereby providing means by which said opposite side of said pump may be connected to said ground potential and said pump to operate;

(d) a first electrically conductive probe extending between upper and lower ends and having its lower end mounted so as to contact the water whose level is being controlled at some predetermined low level;

(e) a second electrically conductive probe extending between upper and lower ends, laterally spaced from said first probe, having its lower end mounted so as to contact the water whose level is being controlled at said low level and having its upper end connected to said ground potential;

(f) a third electrically conductive probe extending between upper and lower ends, laterally spaced from said second probe and having its lower end mounted so as to contact the water whose level is being controlled at some predetermined high level higher than said low level;

(g) first and second integrated logic devices each having first and second input terminals and an output terminal, each said logic device capable of having its output terminal assume a high state depending on both of its respective input terminals assuming a low state and being inoperative to produce such output terminal high state when such condition does not prevail;

(h) said upper end of said first probe connected by a first connection through a first current limiting resistor to said positive voltage source and through a second connection to said first input terminal of said first logic device;

(i) a third connection between said output terminal of said first logic device and said gate terminal of said transistor device;

(j) a fourth connection between said output terminal of said first logic device and said first input terminal of said second logic device;

(k) a fifth connection between said second input terminal of said second logic device and said ground potential;

(l) a sixth connection between said output terminal of said second logic device and said upper end of said third probe and extending through a second current limiting resistor;

(m) a seventh connection between said second input terminal of said first logic device and said upper end of said third probe;

(n) an eighth connection between said upper end of said third probe through a third current limiting resistor and said positive voltage source; and (o) the values of said resistors being selected such that:

(i) when said water level reaches the lower end of said first and second probes, said positive voltage source is grounded through second probe and said first input terminal of said first logic device is brought to a low state;

(ii) when said water level reaches the lower end of said third probe said voltage source is further grounded through said second probe, the second said input terminal of said first logic device is brought to a low state, the output terminal of said first logic device is brought to a high state, said gate terminal of said transistor device assumes said positive voltage and said pump is connected to said ground potential through said drain and source terminals and is caused to operate;

(iii) when said water level recedes below the lower end of said third probe but above the lower end of said first and second probes, said second logic device acts to maintain said second input terminal of said first logic device in a low state and thereby maintains said pump in operation; and (iv) when said level drops below the lower ends of said first and second probes said gate terminal is deenergized and said pump stops operating.

2. An automatic control system as claimed in claim 1 including an alarm device connected through a ninth connection extending between said positive voltage source and said opposite side of said pump and operative to provide an alarm signal when said pump is operating.

3. An automatic control system as claimed in claim 1 including a ninth connection extending between said positive voltage source and said third connection and including a fourth current limiting resistor and a switch operable when closed to connect said positive voltage source to said gate terminal and thereby cause said pump to operate.

4. An automatic control system as claimed in claim 1 including:

(a) an alarm device connected through a ninth connection extending between said positive voltage source and said opposite side of said pump and operative to provide an alarm signal when said pump is operating; and (b) a tenth connection extending between said positive voltage source and said third connection and including a fourth current limiting resistor and a switch operable when closed to connect said positive voltage source to said gate terminal and thereby cause said pump to operate.

5. An automatic control system as claimed in claim 1 including a housing adapted to mount said transistor device, logic devices and connections and to be secured to said pump.

6. An automatic control system for controlling the level of water at a location at which the conditions permit such level to be controlled by pumping comprising:

(a) means providing a positive voltage source and a ground potential;

(b) an electrically operated pump having one side connected to said positive voltage source and an opposite side connectable to said ground potential;

(c) a transistor device having a drain terminal connected to said opposite side of said pump, a source terminal connected to said ground potential and a gate terminal operable when connected to said positive voltage source to cause an electrical path to be established between said drain and source terminals thereby providing means by which said opposite side of said pump may be connected to said ground potential and said pump to operate;

(d) a first electrically conductive probe extending between upper and lower ends and having its lower end mounted so as to contact the water whose level is being controlled at some predetermined low level;

(e) a second electrically conductive probe extending between upper and lower ends, laterally spaced from said first probe, having its lower end mounted so as to contact the water whose level is being controlled at said low level and having its upper end connected to said ground potential;

(f) a third electrically conductive probe extending between upper and lower ends, laterally spaced from said second probe and having its lower end mounted so as to contact the water whose level is being controlled at some predetermined high level higher than said low level;

(g) first and second integrated logic devices each having first and second input terminals and an output terminal, each said logic device being capable of having its output terminal assume a high state depending on both of its respective input terminals assuming a low state and being inoperative to produce such output terminal high state when such condition does not prevail;

(h) a connecting network which interconnects said positive voltage source, ground potential, transistor device terminals, probes and logic device terminals and provides current limiting resistance within selected portions of the network such that:

(i) when said water level reaches the lower end of said first and second probes, said positive voltage source is grounded through said second probe and said first input terminal of said first logic device is brought to a low state;

(ii) when said water level reaches the lower end of said third probe said voltage source is further grounded through said second probe, the second said input terminal of said first logic device is brought to a low state, the output terminal of said first logic device is brought to a high state, said gate terminal of said transistor device assumes said positive voltage and said pump is connected to said ground potential through said drain and source terminals and is caused to operate;

(iii) when said water level recedes below the lower end of said third probe but above the lower end of said first and second probes, said second logic device acts to maintain said second input terminal of said first logic device in a low state and thereby maintains said pump in operation; and (iv) when said level drops below the lower ends of said first and second probes said gate terminal is deenergized and said pump stops operating.

7. An automatic control system as claimed in claim 6 wherein:

(a) said transistor device comprises a TMOS E FET type transistor; and (b) each said logic device comprises a CMOS NOR GATE logic device.

8. An automatic control system for controlling the level of water at a location at which the conditions permit such level to be controlled by pumping comprising:

(a) means providing a positive voltage source and a ground potential;

(b) an electrically operated pump;

(c) a transistor device having a drain terminal, a source terminal and a gate terminal, said gate terminal being operable when connected to said positive voltage source to cause an electrical path to be established between said drain and source terminals;

(d) a first electrically conductive probe positioned at some predetermined low level;

(e) a second electrically conductive and grounded probe positioned at said low level;

(f) a third electrically conductive probe position at some predetermined high level;

(g) first and second integrated logic devices each having first and second input terminals and an output terminal, each said logic device being capable of having its output terminal assume a high state depending on both of its respective input terminals assuming a low state and being inoperative to produce such output terminal high state when such condition does not prevail;

(h) a connecting network which provides current limiting resistance within selected portions of the network and interconnects said positive voltage source, ground potential, pump, probes, transistor device terminals, and logic device terminals in a manner such that:

(i) when said water level reaches said third probe, said pump is energized by said battery and is caused to operate;

(ii) when said water level recedes below said third probe but is above said first and second probes, said pump remains energized by said battery and continues in operation; and (iii) when said level drops below said first and second probes said pump stops operating.

9. An automatic control system as recited in claim 8, further comprising an alarm interconnected to said network in a manner such that when energized said transistor device activates said alarm.

10. An automatic control system as recited in claim 13, wherein said control is contained in a housing having at least one strap receiving aperture.

11. An automatic control system as recited in claim 8, wherein:

(a) each said integrated logic device comprises a CMOS NOR GATE; and (b) said transistor device comprises a TMOS E FET type transistor.

* * * * *

UNITED STATES PATENT AND TRADEMARK OFFICE

CERTIFICATE OF CORRECTION

PATENT NO. : 5,576,582
DATED : November 19, 1996
INVENTOR(S) : Paul S. White

It is certified that error appears in the above-indentified patent and that said Letters Patent is hereby corrected as shown below:

Column 8, line 23, correct "13" to read --8--.

Signed and Sealed this

Eleventh Day of February, 1997

Bruce Lehman

*Attest:*

BRUCE LEHMAN

*Attesting Officer*

*Commissioner of Patents and Trademarks*